United States Patent [19]

Liang

[11] Patent Number: 4,752,186

[45] Date of Patent: Jun. 21, 1988

[54] COOLABLE WALL CONFIGURATION

[75] Inventor: George P. Liang, Jupiter, Fla.

[73] Assignee: United Technologies Corporation, Hartford, Conn.

[21] Appl. No.: 277,481

[22] Filed: Jun. 26, 1981

[51] Int. Cl.[4] ..... F01D 5/08

[52] U.S. Cl. ..... 416/97 R

[58] Field of Search ..... 416/97 R, 96 A, 95, 416/96 R; 415/115, DIG. 1

[56] References Cited

U.S. PATENT DOCUMENTS

| | | | |
|---|---|---|---|
| 2,991,973 | 7/1961 | Cole et al. | 416/97 |
| 3,161,385 | 12/1964 | Kramer | 244/130 |
| 3,220,697 | 11/1965 | Smuland et al. | 416/96 |
| 3,554,663 | 1/1971 | Helms | 416/97 R |
| 3,628,885 | 12/1971 | Sidenstick et al. | 416/95 |
| 3,688,833 | 9/1972 | Bykov et al. | 416/97 UX |
| 3,819,295 | 6/1974 | Hauser et al. | 416/97 R |
| 3,872,563 | 3/1975 | Brown et al. | 416/97 R X |
| 3,994,622 | 11/1976 | Schultz et al. | 416/96 A XC |
| 4,105,364 | 8/1978 | Dodd | 416/96 X |
| 4,168,348 | 9/1979 | Bhangu et al. | 416/95 X |
| 4,183,716 | 1/1980 | Takahara et al. | 416/96 A |
| 4,203,706 | 5/1980 | Hess | 415/115 X |

FOREIGN PATENT DOCUMENTS

| | | | |
|---|---|---|---|
| 1277685 | 10/1961 | France | 416/92 |
| 1366704 | 9/1974 | United Kingdom | 416/97 R |

*Primary Examiner*—Harvey C. Hornsby
*Assistant Examiner*—Frankie L. Stinson
*Attorney, Agent, or Firm*—Stephen E. Revis

[57] ABSTRACT

A coolable wall configuration includes a slot formed between two wall portions for carrying coolant fluid in a downstream direction wherein the slot is divided into a plurality of parallel channels by as plurality of parallel barrier walls extending in a direction perpendicular to the downstream direction, the barrier walls having openings therethrough at regular intervals to interconnect the channels, wherein the openings in adjacent barrier walls are staggered so that cooling fluid flowing through each opening impinges upon a wall portion of the next barrier wall and ultimately traverses a square wave-like flow path as it moves downstream from channel to channel. This configuration is particularly suitable for use in the trailing edge region of an airfoil.

13 Claims, 2 Drawing Sheets

COOLABLE WALL CONFIGURATION

TECHNICAL FIELD

This invention relates to cooling of walls, and more particularly to means for cooling the trailing edge region of airfoils.

BACKGROUND ART

Airfoils constructed with cavities and passageways for carrying cooling fluid therethrough are well known in the art. For example, it is common to construct airfoils with spanwise cavities within the wider forward portion. These cavities often have inserts disposed therein which define compartments and the like within the cavities. The cooling fluid is brought into the cavities and compartments and some of the fluid is often ejected therefrom via holes in the airfoil walls to film cool the external surface of the airfoil. The trailing edge region of airfoils is generally more difficult to cool than other portions of the airfoil because the cooling air is hot when it arrives at the trailing edge since it has been used to cool other portions of the airfoil, and the relative thinness of the trailing edge region limits the rate at which cooling fluid can be passed through that region.

A common technique for cooling the trailing edge region is to pass cooling fluid from the larger cavity in the forward portion of the airfoil through the trailing edge region of the airfoil via a plurality of smaller diameter drilled passageways. Such an airfoil construction is shown in U.S. Pat. No. 4,183,716. Another common technique for convectively cooling the trailing edge region is by forming a narrow slot between the walls in the trailing edge region and having the slot communicate with a cavity in the forward portion of the airfoil and with outlet means along the trailing edge of the airfoil. The slot carries the cooling fluid from the cavity to the outlets in the trailing edge. An array of pedestals extending across the slot from the pressure to the suction side wall are typically incorporated to create turbulence in the cooling air flow as it passes through the slot and to increase the convective cooling surface area of the airfoil. The rate of heat transfer is thereby increased, and the rate of cooling fluid flow required to be passed through the trailing edge region may be reduced. U.S. Pat. Nos. 3,628,885; 3,819,295; and 3,994,622 are examples of airfoils constructed in this manner.

Another airfoil constructed with improved means for carrying cooling fluid from a cavity in the forward portion of the airfoil through the trailing region and out the trailing edge of the airfoil is shown in commonly owned U.S. Pat. No. 4,203,706. In that patent wavy criss-crossing grooves in opposing side walls of the trailing edge region provide tortuous paths for the cooling fluid through the trailing edge region and thereby improve heat transfer rates.

Despite the variety of trailing edge region cooling configurations described in the prior art, further improvement is always desirable in order to allow the use of higher operating temperatures, less exotic materials, and reduced cooling air flow rates through the airfoils, as well as to minimize manufacturing costs.

DISCLOSURE OF INVENTION

One object of the present invention is improved means for cooling a wall.

Another object of the present invention is an improved trailing edge region cooling configuration for an airfoil.

Yet another object of the present invention is an airfoil trailing edge region cooling configuration suitable for use in an airfoil having high camber or twist in the trailing edge region.

A further object of the present invention is an airfoil trailing edge cooling configuration adapted for easy manufacture in the form of radial (i.e., spanwise) wafers.

According to the present invention a coolable wall comprises a plurality of closely spaced longitudinally extending parallel channels enclosed therewithin separated by barrier walls, each of said barrier walls having openings therethrough at regular intervals along its length to provide communication between channels, said openings being staggered relative to the openings through adjacent walls such that the openings are not aligned, whereby cooling fluid introduced into one of said channels passes through the openings in the barrier walls and impinges upon wall portions of next succeeding barrier walls as it flows from channel to channel.

The wall construction is particularly suitable for cooling the trailing edge region of an airfoil. Thus, according to a preferred embodiment of the present invention, an airfoil would have a spanwise slot in its trailing edge region with a plurality of spanwise, adjacent barrier walls extending across the slot from the suction side wall to the pressure side wall defining a plurality of parallel, spanwise channels therebetween. Each of the barrier walls would have openings therethrough at regular intervals along its length, the openings through adjacent barrier walls being staggered in the spanwise direction such that the openings are not aligned and cooling air passing through the openings in the downstream direction impinges upon a wall portion of the next succeeding barrier wall.

This wall structure, as used in an airfoil according to the present invention, results in a mazelike pattern of cooling fluid channels which requires the cooling fluid to flow downstream through the trailing edge region slot along a plurality of square wave-like flow paths while providing high heat transfer rates due to the continuous impingement of the cooling air against the barrier walls. The spacing between the openings in the barrier walls, the size of the openings, and the spacing between the barrier walls are selected in accordance with the teachings of the present invention so as to generate internal heat transfer coefficients substantially higher than prior art pedestal cooling configurations, particularly at high Reynolds numbers. Furthermore, as described hereinbelow, this trailing edge region configuration may be manufactured as a plurality of radial wafers having their bond planes at an angle to the trailing edge centerline, as well as by other more conventional manufacturing techniques.

The foregoing and other objects, features and advantages of the present invention will become more apparent in the light of the following detailed description of preferred embodiments thereof as shown in the accompanying drawing.

BEST MODE FOR CARRYING OUT THE INVENTION

Figure 1:
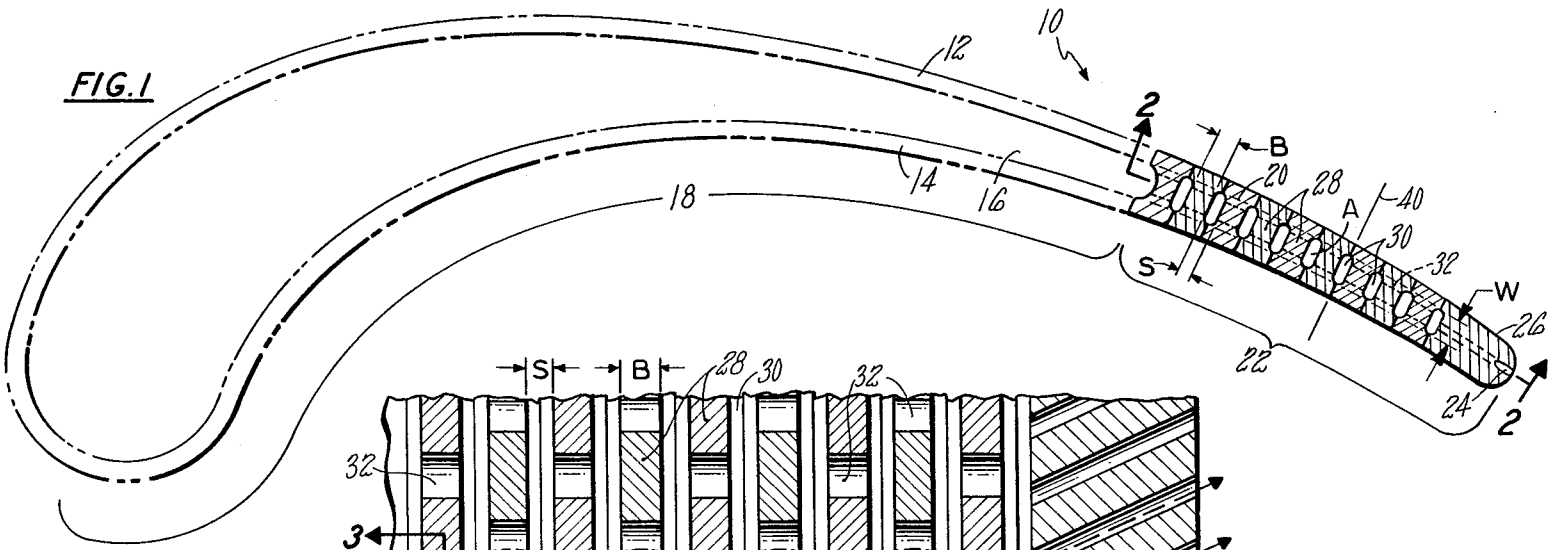
FIG. 1 is a cross-sectional view of an airfoil incorporating the features of the present invention.

As an exemplary embodiment of the present invention, consider the two-piece hollow airfoil generally represented by the numeral 10 in FIG. 1. The airfoil 10 comprises a suction side wall 12 and a pressure side wall 14. The pressure and suction side walls are spaced apart defining a spanwise cooling air cavity 16 in the forward portion 18 of the airfoil and a spanwise slot 20 of width W (not necessarily constant) in the trailing edge region 22. The airfoil 10 also includes a plurality of outlet passages 24 through the trailing edge 26. The slot 20 communicates with the cavity 16 for receiving cooling fluid therefrom and with the passages 24 for discharging the cooling fluid from the slot 20.

Since the present invention is concerned with the cooling configuration in the trailing edge region 22, the configuration of the forward portion 18 of the airfoil is not critical except to the extent that it must have a cooling air cavity therethrough in communication with the slot 20. In this application the term "cavity" is used in its broadest sense to encompass any cooling air passageway, compartment, or the like, through the forward portion 18 which is in communication with the slot 20. For purposes of simplicity, the airfoil 10 of the drawing is shown to be completely hollow in the forward portion 18, with no inserts within the cavity 16. Also, although none are shown, there may be passages through the walls 12 and 14 over the span of the airfoil to provide film cooling over the outer surface of the airfoil, as is well known to those skilled in the art.

Figure 2:
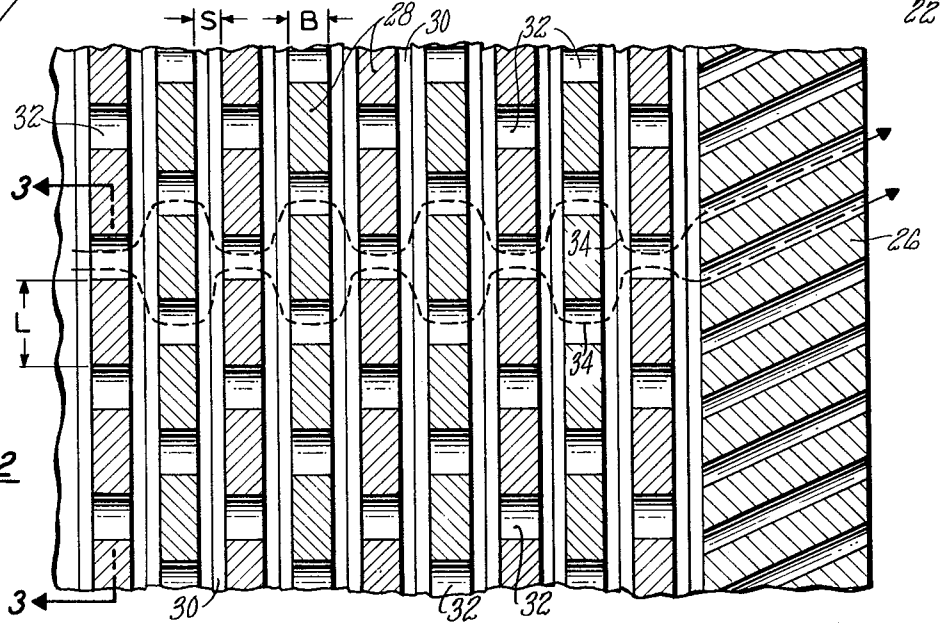
FIG. 2 is an enlarged cross-sectional view taken along the line 2—2 in FIG. 1.
Figure 3:
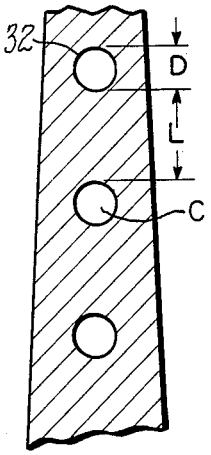
FIG. 3 is a cross-sectional view taken along the line 3—3 in FIG. 2.

Turning, now, to the trailing edge region 22, as best shown in FIGS. 1 and 2, a plurality of barrier walls 28 extend across the slot 20 from the suction side wall 12 to the pressure side wall 14. The barrier walls 28 have a width B, and are spaced from each other a distance S to define spanwise, parallel channels of width S within the trailing edge region 22. Each barrier wall 28 has a plurality of openings or passages 32, with an interval L between passages. In this embodiment the passages 32 are cylindrical holes of diameter D (see FIG. 3). The passages 32 provide communication between the channels 30, and interconnect the cavity 16 with the outlet passages 24.

The passages 32 through adjacent barrier walls 28 are staggered in the spanwise direction such that the openings are not aligned, and air passing through the passages thereby impinges upon that portion of the next succeeding barrier wall opposite each passage 32. This arrangement of barrier walls, passages and channels defines a maze-like flow path pattern which requires the cooling air to flow downstream through the trailing edge region slot 20 along a plurality of square wave-like flow paths represented by the dashed lines 34 in FIG. 2. The continuous impingement of the cooling air against the barrier walls in a multiplicity of locations as travels through the maze provides high heat transfer rates throughout the trailing edge region.

The successful operation of this configuration depends upon several dimensional factors within the trailing edge region. One important relationship is the interval L between adjacent passages 32 relative to the height of the passages 32, (i.e., their dimension in the spanwise direction), which, in this embodiment, is the passage diameter D. This ratio is important to ensure that essentially the entire airstream through a passage 32 impinges upon the next succeeding barrier wall and does not simply pass straight through such next wall without first impinging and then turning in a spanwise direction. While it is desirable to turn all of the air essentially 90° upon leaving a passage 32, it is not desirable to have the interval L between passages 32 so great that the flow, after impingement, becomes relatively nonturbulent flow through a long length or portion of a channel 30 before the flow turns downstream again. In essence, it is preferred that the amplitude of the square wave-like flow path be small so the air quickly changes directions continuously as it flows downstream. It is estimated that good results may be achieved when the height D is no greater than 0.050 inch and the ratio of the height D to the interval L is between 0.20 and 0.5, preferably between 0.33 and 0.5. Also, in order to avoid or minimize the occurrence of nonturbulent flow, the passages 32 should not be too long in the downstream direction. Therefore, it is preferred that the width B of the barrier walls be less than about 0.040 inch.

Additionally, it is important that the distance S between adjacent barrier walls be small enough to ensure that the air exiting from the holes 32 impinges upon the downstream barrier wall with sufficient velocity to achieve the desired heat transfer rate. Also, since the barrier walls provide additional convective heat transfer surface area, the greater the spacing S between walls the fewer the number of walls and the smaller the convective heat transfer surface area. Too large a channel cross-sectional area may also result in excessively great expansion of the cooling air exiting from the passages 32, with attendant decreases in cooling air velocity and, therefore, reduced heat transfer cooling rates. Based upon these considerations, it is preferred that the cross-sectional areas A of the channels 30 (perpendicular to the spanwise direction) and the cross-sectional area C of the passages 32 (perpendicular to the downstream direction) be chosen such that the ratio of the channel area A to the passage area C is between 0.5 and 1.5. A smaller ratio might result in choked flow or too high a pressure loss, while a larger ratio may unacceptably reduce the convective heat transfer surface area and permit excessive expansion of the cooling air as it leaves the passages 32 resulting in insufficient impingement velocity. It is also preferred (although not necessarily required) that the smallest dimension of the passages 32 be no less than 0.020 inch to avoid clogging.

Figure 4:
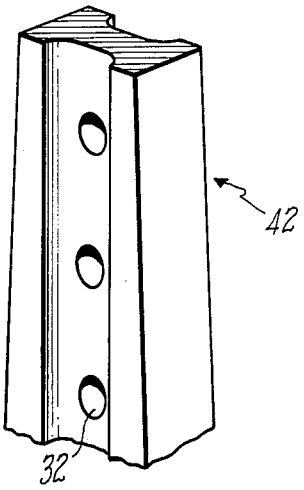
FIG. 4 is an illustrative perspective view showing part of a radial wafer used in the construction of the airfoil of FIG. 1.

The airfoil of the embodiment hereinabove described may easily be constructed from radial wafers having bond planes 40 as shown in FIG. 1. These bond planes are parallel to each other. Each radial wafer is initially formed as a solid block or plate having two parallel sides which correspond to the bond planes (except, of course, for the last wafer of a stack) while the other two sides are machined or initially formed to define the pressure and suction side external surfaces of the airfoil 10. A spanwise groove is then machined or otherwise formed in each of the bond planes. Each groove will form half of a channel 30 when the wafers are bonded together. The openings or holes 32 are then drilled or machined through the wafers to interconnect the grooves. As best shown in FIG. 4, each finished wafer 42 has the appearance of an I-beam with holes 32 therethrough. It is apparent that the trailing edge region cooling configuration of this invention can be used with airfoils having high camber or twist in the trailing edge region without significantly increasing the cost of manufacture.

Figure 5:
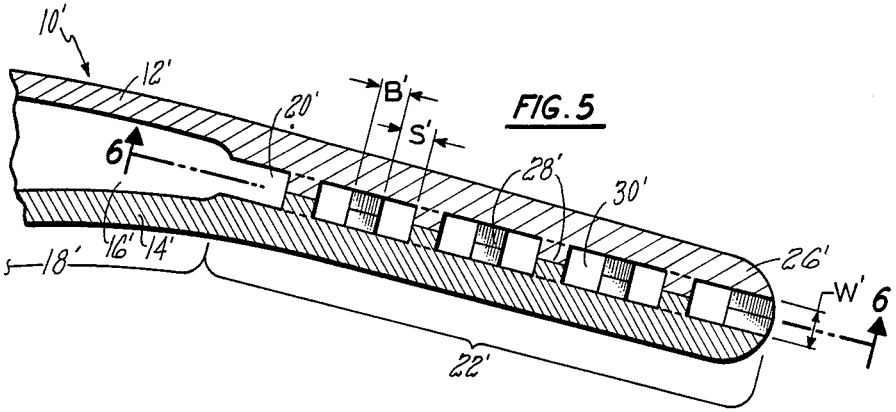
FIG. 5 is an enlarged cross-sectional view taken along the line 5—5 in FIG. 6 showing the trailing edge region of an airfoil constructed according to another embodiment of the present invention.
Figure 6:
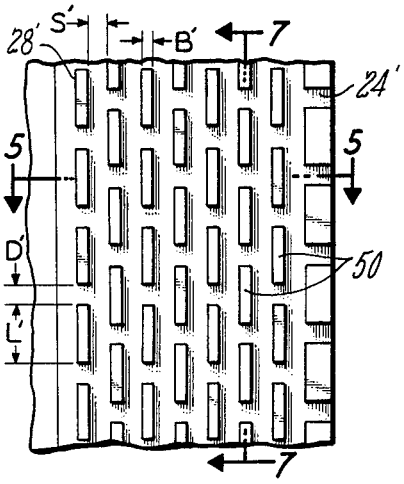
FIG. 6 is a reduced size cross-sectional view taken along the line 6—6 in FIG. 5.
Figure 7:
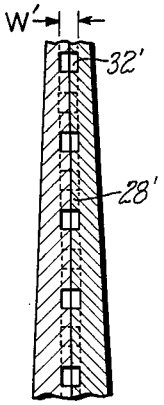
FIG. 7 is a cross-sectional view taken along the line 7—7 in FIG. 6.

FIGS. 5–7 show another embodiment of the present invention which is particularly well suited for use in a two-piece airfoil configuration or for an airfoil having a two-piece trailing edge region. In this embodiment the trailing edge region centerline is the preferred bond plane. Features which correspond to features of the embodiment described with respect to FIGS. 1–4 are given the same, but primed, reference numerals. Thus, the airfoil 10' comprises a suction side wall 12' and a pressure side wall 14'. The pressure and suction side walls are spaced apart defining, in the forward portion 18' of the airfoil, a cooling air cavity 16', and, in the trailing edge region 22', a spanwise slot 20' of width W'. The airfoil 10' also includes a plurality of outlet passages 24' through the trailing edge 26'. The slot 20' communicates with the cavity 16' for receiving cooling fluid therefrom and with the passages 24' for discharging the cooling fluid from the slot 20'.

The trailing edge region 22' comprises a plurality of barrier walls 28' extending across the slot 20' from the suction side wall 12' to the pressure side wall 14'. The barrier walls 28' have a width B', and are spaced from each other a distance S' to define spanwise, parallel channels 30' of width S'. Passages 32' through the barrier walls 28' have a square or rectangular cross section of dimensions D' by W' in a plane perpendicular to the downstream direction. As in the previous embodiment, the location of the passages 32' in each barrier wall is staggered relative to passages 32' in adjacent barrier walls.

It is convenient to think of this embodiment as an airfoil having a trailing edge region with a slot therethrough wherein the slot includes a plurality of spanwise, parallel rows if elongated pedestals 50 of length L' (FIG. 6) and width B' extending across the slot from the suction side wall to the pressure side wall. There is a gap of dimension D' between pedestals within a row; and the pedestals in adjacent rows are staggered such that the center of each pedestal is aligned with the gap between adjacent pedestals in the preceding row so as to be impinged upon by cooling air flowing through the gap. For reasons already discussed with regard to the first described embodiment, preferably the pedestal length M is two to five times, most preferably two to three times, the gap height D'; and S', the distance between rows of pedestals 50, is 0.5–1.5 times the distance D', where D' is preferably between 0.020 and 0.050 inch. Since the gap width and channel width are the same (W') in this embodiment, the ratio of S' to D' is the same as the ratio of the channel cross-sectional area (S'×W') to gap cross-sectional area (D'×W').

Figure 8:
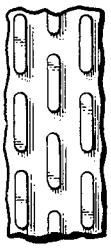
FIG. 8 is a cross-sectional view similar to that shown in FIG. 6 showing an alternate shape for the pedestals of the present invention.

FIG. 8 shows an alternate shape for the pedestals 50 which will reduce pressure losses through the slot due to the elimination of sharp corners on the pedestals.

As mentioned earlier, this latter embodiment is particularly well suited for manufacture as a two-piece airfoil having its bond plane along the airfoil (and thus the trailing edge region) centerline. Each piece is preferably formed with pedestals extending inwardly from the suction or pressure side wall 12', 14' respectively, a distance equivalent to about half the slot width W'. The pedestals in each piece may be manufactured by casting, electrodischarge machining, electrochemical milling, or the like.

Although the invention has been shown and described with respect to a preferred embodiment thereof, it should be understood by those skilled in the art that other various changes and omissions in the form and detail thereof may be made therein without departing from the spirit and the scope of the invention. For example, it is apparent that the cooling configuration of the present invention may be used to cool any wall thick enough to accommodate the design features thereof, or any pair of closely spaced walls. Thus, the invention could even be used to cool a wall or portion of a wall which is part of the forward portion of the airfoil.

I claim:

1. An airfoil having a suction side wall and a pressure side wall defining a forward portion of said airfoil and a trailing edge region of said airfoil, said trailing edge region including a trailing edge, said suction side wall and said pressure side wall being spaced apart defining a cooling air cavity within said forward portion and a spanwise slot in said trailing edge region, said slot being in communication with said cavity for receiving cooling air from said cavity, said airfoil including means defining outlet passageways through said trailing edge in communication with said slot for discharging cooling air from said slot through said trailing edge; and a plurality of spanwise barrier walls of width B in the downstream direction extending across said slot from said suction side wall to said pressure side wall to define a plurality of parallel, spanwise channels therebetween having a cross-sectional area A perpendicular to the spanwise direction, each of said barrier walls having openings therethrough along its length with intervals of length L between them, said openings providing communication between said channels, said openings through adjacent barrier walls being staggered in the spanwise direction such that said openings are not aligned, wherein said openings have a height D and a cross-sectional area C perpendicular to the downstream direction, L being two to five times D, and A being one-half to one and one-half times C, said dimensions A, C, D and L being selected to result in substantially all the cooling air passing through each of said openings impinging upon said adjacent downstream barrier wall and being turned substantially 90°.

2. An airfoil having a suction side wall and a pressure side wall defining a forward portion of said airfoil and a trailing edge region of said airfoil, said trailing edge region including a trailing edge, said suction side wall and said pressure side wall being spaced apart defining a cooling air cavity within said forward portion and a spanwise slot in said trailing edge region, said slot being in communication with said cavity for receiving cooling air from said cavity, said airfoil including means defining outlet passageways through said trailing edge in communication with said slot for discharging cooling air from said slot through said trailing edge; and a plurality of spanwise, parallel rows of elongated pedestals of length L in the spanwise direction and width B in the downstream direction, said pedestals extending across said slot from said suction side wall to said pressure side wall, said rows being spaced apart a distance S, the pedestals in each row being spaced apart a distance D, the spanwise positions of said pedestals in adjacent rows being staggered such that each pedestal is aligned with the space between adjacent pedestals in the preceding row, wherein L is two to five times the distance D, and S is one-half to one and one-half times the distance D, said dimensions L, D, and S being selected to result in substantially all the cooling air passing through said spaces between pedestals in each row impinging upon said pedestal with which said space is aligned in the adjacent downstream row and being turned substantially 90°.

3. The airfoil according to claims 1 or 2 wherein D is not greater than 0.050 inch.

4. The airfoil according to claim 3 wherein B is not greater than about 0.040 inch.

5. The airfoil according to claim 1 wherein said openings are cylindrical and have a diameter D.

6. The airfoil according to claim 5 wherein said airfoil trailing edge region comprises a plurality of bonded together radial wafers.

7. The airfoil according to claim 6 wherein the bond planes of said radial wafers are parallel to each other and at an angle with respect to the trailing edge region centerline.

8. The airfoil according to claims 1 or 2 wherein L is two to three times D.

9. Coolable wall means comprising:

a first wall portion;

a second wall portion spaced apart from said first wall portion a distance W defining a slot therebetween for carrying cooling fluid therethrough in a downstream direction;

a plurality of parallel carrier walls of width B in the downstream direction disposed within said slot, said barrier walls spaced apart a distance S and extending in a direction perpendicular to the downstream direction dividing said slot into a plurality of parallel channels of cross-sectional area A perpendicular to the length of said channels, each of said barrier walls having spaced apart openings therethrough along its length to provide communication between said channels, the intervals between said openings being of length L, said openings through adjacent barrier walls being staggered such that said openings are not aligned, said openings having a height D in the direction of channel length and a cross-sectional area C perpendicular to the downstream direction, L being two to five times D, and A being one-half to one and one-half times C; and a source of cooling fluid in communication with the upstream-most channel within said slot, said wall means including outlet passages in communication with the downstreammost channel within said slot for permitting cooling fluid to leave said slot, said dimensions A, C, D and L being selected to result in substantially all the cooling air passing through each of said openings impinging upon said adjacent downstream barrier wall and being turned substantially 90°.

10. The coolable wall means according to claim 9 wherein said first wall portion is the suction side wall of the trailing edge region of an airfoil, and said second wall portion is the pressure side wall of the trailing edge region of an airfoil.

11. The coolable wall means according to claim 9 wherein L is two to three times D.

12. The coolable wall means according to claims 9 or 11 wherein D is not greater than 0.050 inch and B is not greater than 0.04 inch.

13. An airfoil comprising:

wall means defining a spanwise cooling air cavity, said wall means also comprising two closely spaced-apart first walls at least one of said first walls defining an outer surface of said airfoil; and a plurality of spanwise, parallel, spaced-apart, barrier walls of width B disposed in the space between said first walls and extending from one of said first walls to the other, a plurality of spanwise parallel channels being defined by said barrier walls, said channels having a cross-sectional area A perpendicular to the spanwise direction, a first of said channels being in communication with said cooling air cavity for receiving cooling air from said cavity, said airfoil wall means including outlet passageways in communication with a second of said channels for discharging cooling air from said airfoil, each of said barrier walls having openings therethrough along its length with intervals of length L between them, said openings providing communication between said channels, said openings through adjacent barrier walls being staggered in the spanwise direction such that said openings are not aligned, wherein said openings have a height D and a cross-sectional area C perpendicular to the downstream direction, L being two to five times D, and A being one-half to one and one-half times C, said dimensions A, C, D and L being selected to result in substantially all the cooling air passing through each of said openings impinging upon said adjacent barrier wall and being turned substantially 90°.

* * * * *